US006229421B1

(12) United States Patent
Floyd et al.

(10) Patent No.: US 6,229,421 B1
(45) Date of Patent: May 8, 2001

(54) AUTOSECURING SOLENOID

(75) Inventors: Tracy Floyd; John Passafiume; Joseph Luciano; Tommy Lowe, all of Lexington, KY (US)

(73) Assignee: Mas-Hamilton Group, Inc., Lexington, KY (US)

( * ) Notice: Subject to any disclaimer, the term of this patent is extended or adjusted under 35 U.S.C. 154(b) by 0 days.

(21) Appl. No.: 09/442,897

(22) Filed: Nov. 18, 1999

Related U.S. Application Data

(60) Provisional application No. 60/109,146, filed on Nov. 20, 1998.

(51) Int. Cl.[7] ..... H01F 7/08

(52) U.S. Cl. ..... 335/253; 335/229; 335/233

(58) Field of Search ..... 335/170, 253, 335/254, 167–169, 171, 179, 229–235

(56) References Cited

U.S. PATENT DOCUMENTS 4,078,709 * 3/1978 Jenkins ..... 335/253
4,383,234 * 5/1983 Yatsushiro et al. ..... 335/253

* cited by examiner

*Primary Examiner*—Ray Barrera
(74) *Attorney, Agent, or Firm*—Rustan J. Hill; Arent Fox Kintner Plotkin & Kahn, PLLC

(57) ABSTRACT

An autosecuring solenoid utilizes an interposing device that restrains the solenoid plunger when the solenoid is de-energized and/or energized, effectively preventing undesired movement of the plunger. When a voltage is applied across the coil, the flowing current creates an magnetic field. This field causes the plunger to slide within the solenoid cavity, unless restrained. This field also causes displacement of a movable magnet in the interposing device. The direction of motion of the movable magnet will depend on the magnetic field orientation of the movable magnet with respect to the magnetic field. Thus, the interposing device may move either toward or away from the plunger. Additionally, if using two interposing devices, one device could move away from the plunger and the second device could move toward the plunger. The second interposing device could even permit the plunger to move until the second interposing device engaged a recess or notch in the plunger. The first and/or second interposing devices may be restored by attraction between the movable magnet and the plunger or top of the interposing housing when the solenoid is de-energized. Alternatively, a second small magnet, spring, or other device in the housing of the interposing device returns the movable magnet to its desired position when the solenoid is de-energized.

5 Claims, 3 Drawing Sheets

AUTOSECURING SOLENOID

This application claims the benefit of U.S. Provisional Application No. 60/109,146, filed Nov. 20, 1998.

FIELD OF THE INVENTION

This invention relates to the field of solenoids and specifically to an autosecuring solenoid that prevents unwanted movement of the solenoid plunger that may occur when an external force is applied to the solenoid, displacing the plunger.

DESCRIPTION OF THE RELATED ART

Electronic solenoids are employed in a wide variety of electronic, electrical, and electro-mechanical devices. The basic solenoid has an outer case and an internal cavity. Typically, one or more coils will be located between the cavity and the outer case. A plunger slides within the cavity. At least a portion of the plunger is magnetically permeable, typically this portion is formed from iron or steel. When the coil of the solenoid is energized, the center of the magnetically permeable portion moves or tries to move to the center of the magnetic field produced by the energized coil(s). After removing the magnetic field the plunger remains in position unless an outside force, typically produced by a spring, returns the plunger to its original position. With the solenoid de-energized the movement of the plunger is not restrained, unless a spring or other device limits/restrains the movement of the plunger.

Some solenoids have a magnetic latch that holds the plunger in the energized position even after the solenoid is de-energized. Typically the magnetic latch uses a magnet in one end of the solenoid case, the magnetic field of this magnet is typically aligned with the field produced by the coil when energized to pull the plunger into the solenoid. The plunger will be held in contact with this magnetic latch against the spring force until an opposing magnetic field is induced in the coil. The opposing magnetic field must reduce the magnetic attraction of the plunger to the magnetic latch to the point where the spring can pull the plunger away from the magnetic latch and return the plunger to its original position.

With a solenoid either energized or de-energized the plunger moves when the solenoid is subject to an impact or shock. The plunger will even move when the return spring is used. Both the return spring and an magnetic field produce restorative forces, but even these forces may not be sufficient to prevent undesired plunger movement. The displacement of the plunger during or after a shock impact may be sufficient to cause the plunger to enable and/or actuate the device associated with the plunger. This movement of the plunger is typically undesired.

An example of the effects of undesired plunger movement with the solenoid de-energized may be shown in solenoid actuated electronic locks.

Electronic locks often contain solenoids to open or place the lock in a condition where the operator may open the lock upon entry of a correct combination code. The use of solenoids, in this manner, in electronic locks has been known for some time. In operation, the solenoid typically provides some linear motion for a coupling component, such as a plunger and/or latch, to provide an interlock to a device external to the solenoid, such as a sliding bar, handle, or other mechanical device that places the lock in a condition that allows the bolt to be retracted.

The drawback in utilizing a solenoid in this configuration is that the mass of the solenoid plunger is only constrained by a spring or a magnetic field and may move when subject to external shock, impact, and/or external strikes. The application of an external force to the lock and/or security container develops momentum in the solenoid plunger. Thus, the solenoid plunger may move and place the lock in a condition where the lock may be opened without authorized actuation of the solenoid.

Unauthorized engagement of the aforementioned mechanical means has been accomplished in the prior art by interposing a mechanical stop to prevent movement of the plunger. The mechanical stop has acted to minimize the lateral movement of the solenoid plunger absent authorization, while allowing the plunger to actuate upon entry of the correct predetermined combination code or key code. The mechanical stop has accomplished this by moving in response to the amount of external force applied to the lock to act as a physical barrier set in the pathway of the plunger. However, such a stop adds to the assembly cost and complexity of the lock. Furthermore, the stop is less effective in that it decreases but does not halt movement of the solenoid plunger.

Alternatively, in the prior art, unauthorized engagement of the aforementioned mechanical members has been prevented by use of a second solenoid. The second solenoid provides adequate mechanical reinforcement of the plunger. However, this expends rather than conserves energy as both solenoids require power to operate. This is a significant disadvantage in a self-powered lock, which is constrained by limitations on available power.

In view of the foregoing limitations and shortcomings of the prior art devices, as well as other disadvantages not specifically mentioned above, it should be apparent that there exists a need in the art for a solenoid that prevents undesired solenoid plunger movement.

OBJECTS OF THE INVENTION

It is therefore a primary object of the present invention to provide a secure retaining system for a solenoid plunger to prevent plunger movement caused by application of an external force.

It is a further object of the present invention to provide a device utilizing one or more electrically excited coils to produce one or more magnetic fields for the purpose of moving a solenoid plunger and a interposing device.

It is a further object of the present invention to provide an autosecuring solenoid that can hold the solenoid plunger fixed in more than one position eliminating unauthorized plunger movement while the solenoid is de-energized and also while it is energized.

SUMMARY OF THE INVENTION

Briefly described, these and other objects are accomplished according to the present invention by providing an autosecuring solenoid. This solenoid utilizes an interposing device that restrains the solenoid plunger when the solenoid is de-energized and/or energized, effectively preventing undesired movement of the plunger. When a voltage is applied across the coil, the flowing current creates an magnetic field. This field causes the plunger to slide within the solenoid cavity, unless restrained. This field also causes displacement of a movable magnet in the interposing device. The direction of motion of the movable magnet will depend on the magnetic field orientation of the movable magnet with respect to the magnetic field. Thus, the interposing device may move either toward or away from the plunger.

Additionally, if using two interposing devices, one device could move away from the plunger and the second device could move toward the plunger. The second interposing device could even permit the plunger to move until the second interposing device engaged a recess or notch in the plunger. The first and/or second interposing devices may be restored by magnetic attraction between the movable magnet and the plunger or top of the interposing housing when the solenoid is de-energized. Alternatively, there is a second small magnet, spring, or other means in the housing of the interposing device to return the movable magnet to its desired position when the solenoid is de-energized.

While the autosecuring solenoid has immediate application in an electronic lock, it is readily apparent that the autosecuring solenoid is desirable for use in any solenoid operated/accuated device that may be exposed to external forces, attacks, vibration or other interfering stimuli acting to cause potential undesired movement of the solenoid plunger. For this reason, the autosecuring solenoid is not intended to be limited to use in electronic locks. Furthermore, additional benefits and advantages of the present invention will become apparent to one skilled in the art to which the present invention relates from the subsequent description of the preferred embodiment and the appended claims, taken in conjunction with the accompanying drawings.

BRIEF DESCRIPTION OF THE DRAWINGS

The accompanying drawings incorporated in and forming part of the specification illustrate several aspects of the present invention. In the drawings.

Reference will now be made in detail to the present preferred embodiment to the invention, examples of which are illustrated in the accompanying drawings.

DESCRIPTION OF THE PREFERRED EMBODIMENT

Figure 1:
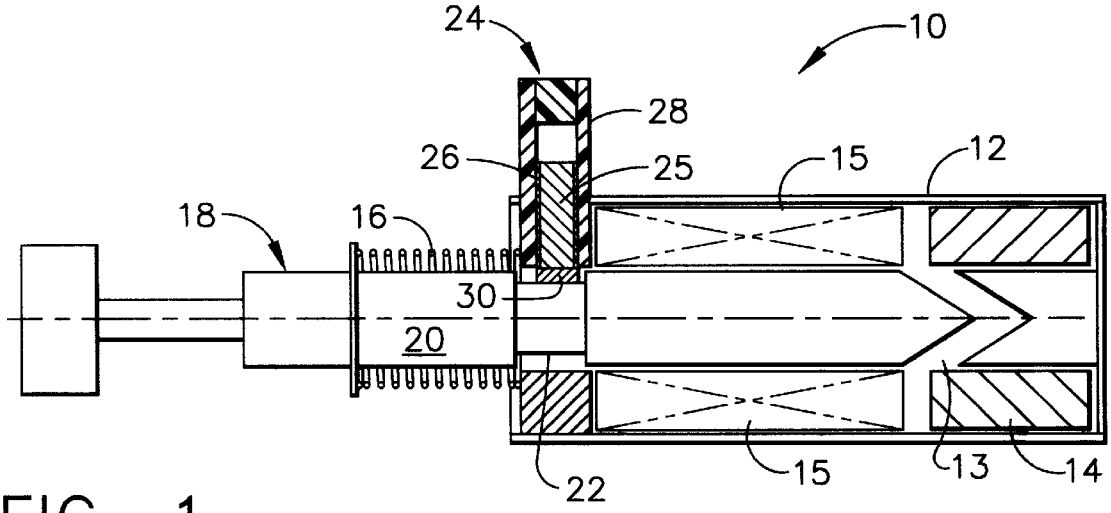
FIG. 1 is a longitudinal cross section of a first embodiment of the solenoid of the present invention showing the interposing device engaging the plunger when the solenoid is de-energized.

Referring now in detail to the drawings, there is shown in FIG. 1 a solenoid 10 of the present invention with the solenoid 10 de-energized. The solenoid 10 has a body 12 containing a magnetic latch 14, coils 15, and cavity 13. The coils 15 typically surround cavity 13. A plunger 18 slides horizontally within cavity 13 in body 12. Typically, spring 16 connects plunger 18 to body 12 and returns plunger 18 to its initial (at rest) position when solenoid 10 is de-energized. Solenoids 10 with a magnetic latch 14 typically require a reverse magnetic field to disengage plunger 18 from latch 14. Plunger 18 has a shaft 20 with at least one recess 22 inset into the shaft 20. As the plunger 18 slides within the cavity 13, the recess 22 aligns and dis-aligns with an interposing device 24. The interposing device 24 may engage or disengage from recess 22 of plunger 18 when the solenoid 10 is de-energized. The term recess as used herein includes but is not limited to recesses, notches, detents, grooves, protrusions, steps, key-ways, and/or similar devices. If a detent is used in place of recess 22, then there will be a voltage/current below which the magnetic field developed by coils 15 will not cause movement/displacement of plunger 18.

The interposing device 24 has a moving magnet 25 located within a capsule 26. The capsule 26 may be made of any magnetic or non-magnetic material. Preferably, capsule 26 is formed from a non-magnetic material. The capsule 26 provides strength sufficient to oppose shear forces occurring upon operation of the solenoid 10 and protects the moving magnet 25 from wear. In the preferred embodiment, the capsule 26 has a protrusion 30 that provides a gap between the magnet 25 and the plunger 18. By changing the width of this gap the operation of interposer 24 may be tuned. Although the interposing device 24 may be made without capsule 26, the capsule 26 is contained within the preferred embodiment to increase manufacturing tolerances of the magnet 25 allowing use of magnets with slight variances in size and hence expediting design and manufacture. Without the capsule 26, the moving magnet 25 must be designed with a more exact hardness, shear resistance and magnetic strength to prevent any slippage which may occur upon energization and/or de-energization of the solenoid 10 and to fit into recess 22 in the at rest position. Preferably, capsule 26 slides within housing 28.

In the preferred embodiment, capsule 26 has a protrusion 30 that is in contact with recess 22. The protrusion 30 may be made of a non-magnetic material to prevent the moving magnet 25 from sticking to the plunger 18 and preventing operation of the solenoid 10. Alternatively, shaft 20 may be manufactured from or coated with a non-magnetic material. Shaft 20 may even use a magnetically permeable material so long as the magnet field developed by coils 15 is sufficiently strong to separate moving magnet 25 and capsule 26 from shaft 20 or to force moving magnet 25 and capsule 26 into recess 22.

Housing 24, typically employs the magnetic attraction between the movable magnet 25 and the plunger 18 or top of the interposing housing 24 when the solenoid is de-energized to return the moving magnet 25 and capsule 26, if used, to the desired position when solenoid 10 is de-energized. Alternatively, a small magnet, spring, or other means may be utilized to return the moving magnet 25 and capsule 26, if used, to the desired position when solenoid 10 is de-energized. Alternatively, some embodiments may require the use of a reversed magnetic field to return the moving magnet 25 to its original position without using a small magnet, spring, or other return means. The lack of small magnet, spring or other return means, however, may leave the solenoid susceptible to shock in some circumstances. Housing 24 may also have a reed switch or a mechanical switch operated by the movable magnet 25. This switch could be used to signal the actuation of solenoid 10.

Figure 2:
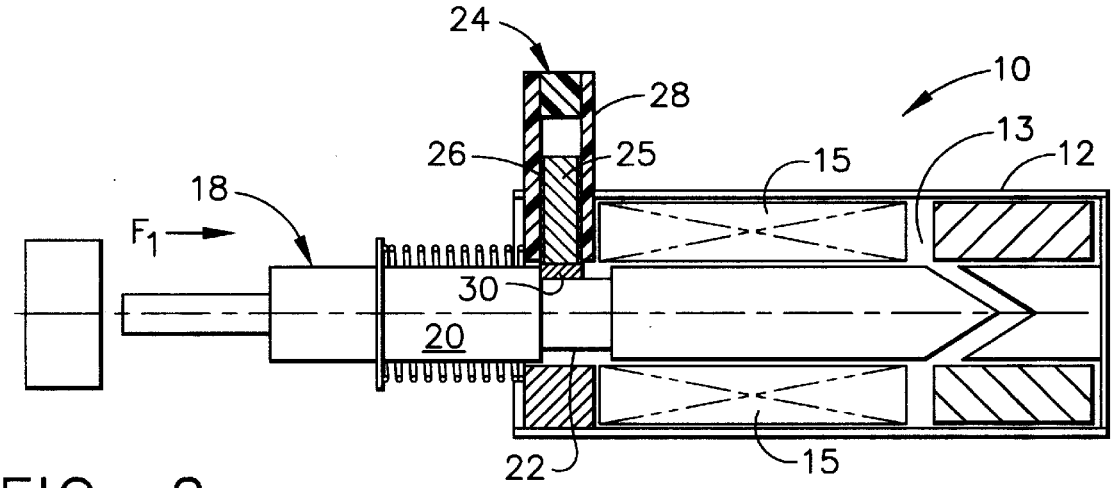
FIG. 2 is a longitudinal cross section of the solenoid of the present invention showing an external attack upon the solenoid while the interposing device is engaging the plunger.

As shown in FIG. 2, while the solenoid 10 is in a de-energized state, any force $F_1$ applied to the plunger 18 will not cause the plunger 18 to move horizontally due to interposing device 24 engaging recess 22. The protrusion 30 in contact with the recess 22 prevents the plunger 18 from moving horizontally because the shaft 20 is too wide to fit past the protrusion 30. Thus, plunger 18 is restrained from undesired motion.

Figure 3:
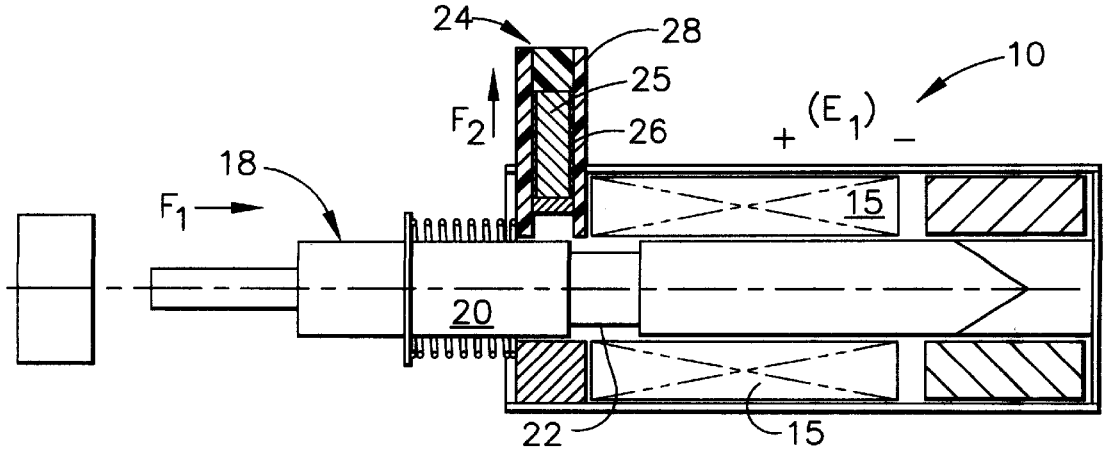
FIG. 3 is a longitudinal cross section of the solenoid of the present invention showing the solenoid energized and the interposing device raised permitting movement of the solenoid plunger.

FIG. 3 illustrates the operation of solenoid 10 when a current is supplied to coils 15 and an magnetic field $E_1$ is generated. The magnetic field $E_1$ from the coils 15 provides a resultant force $F_2$ on the interposing device 24 moving the moving magnet 25 and capsule 26 vertically away from the plunger 18 so that the protrusion 30 clears recess 22 and shaft 20. The housing 28 limits the travel of the moving magnet 25 and capsule 26 by constraining the moving magnet 25 to vertical movement and keeping the moving magnet 25 within the magnetic field $E_1$ generated by coils 15.

The field $E_1$ also generates a force $F_1$ on plunger 18 as the center of the magnetically permeable portion of plunger 18 tries to move to the center of the field $E_1$. The rightward motion of plunger 18 is limited by magnetic latch 14. This latch 14 retains the plunger 18 "pulled in" even after the solenoid is de-energized. Some solenoids do not have magnetic latches 14.

Figure 4:
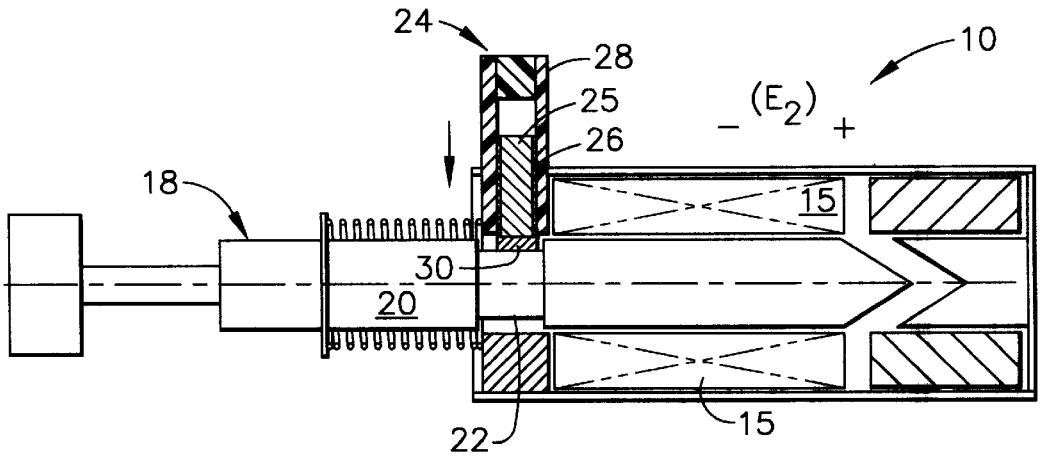
FIG. 4 is a longitudinal cross section of the solenoid of the present invention showing the reverse magnetic field moving the interposing device back into engagement with the plunger and disengaging the plunger from a magnetic latch.

When solenoid 10 has a magnet latch 14, the solenoid 10 is energized with an opposite current flow or voltage polarity applied to the coils 15 to create an opposite magnetic field $E_2$. The magnetic field $E_2$ causes the plunger 18 to repel the magnetic field in the magnetic latch 14 and permits spring 16 to return plunger 18 from the position shown in FIG. 4 to the position shown in FIG. 1. The magnetic field $E_2$, also assists the other restorative forces, if any, in ensuring that moving magnet 25 and capsule 26 completely engage recess 22 of plunger 18, once the recess 22 is located under moving magnet 25 and capsule 26.

Absent magnetic latch 14, when the solenoid 10 is de-energized, plunger 18 may return to the position shown in FIG. 1 at the urging of spring 16. When recess 22 is once again aligned with protrusion 30 of moving magnet 25, moving magnet 25 and/or protrusion 30 may engage recess 22. This movement of moving magnet 25 may result from gravity, spring force (spring not shown), moving magnet 25 repelling from a small magnet in housing 28 of interposing device 24, or the attraction of the moving magnet to the plunger 18.

Figure 5:
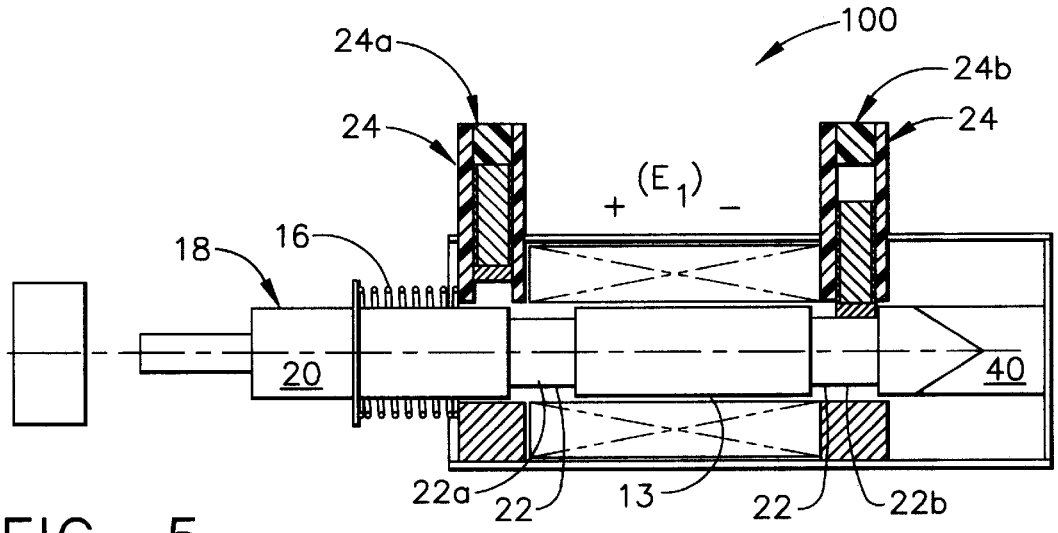
FIG. 5 is a longitudinal cross section of a second embodiment of the solenoid of the present invention using two interposing devices.
Figure 6:
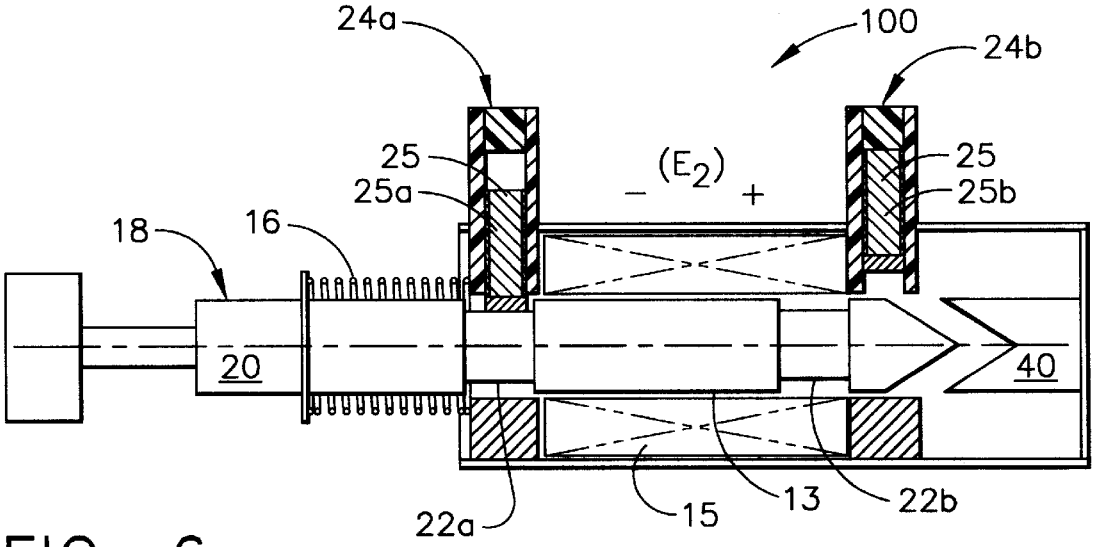
FIG. 6 is a longitudinal cross-section of the solenoid shown in FIG. 5 with a reversed electrical field.

With reference now to FIGS. 5 and 6 showing a second embodiment of the present invention with two interposing devices 24. Solenoid 100 contains more than one recess 22 on plunger 18 and more than one interposing device 24. In this second embodiment, the plunger 18 may be held in place in more than one position by engagement between recess 22*a* and interposer 24*a* or recess 22*b* and interposer 22*b*. For example, the plunger 18 may be held both in its energized position, as shown in FIG. 5, by a recess 22*b* and interposing device 24*b*. When coils 15 of solenoid 100 develop a reverse field $E_2$ as shown in FIG. 5, a recess 22*a* is engaged by interposing device 24*a*. FIG. 6 also illustrates the respective positions of interposing devices 24*a* and 24*b* when solenoid 100 is de-energized.

Typically, the second interposing device 24*b* operates in opposition to the first interposing device 24*a* such that when the moving magnet 25 in the first interposing device 24*a* moves out of contact with the first recess 22*a* and the plunger 18 slides within the cavity 13 into an actuated position against stop 40, the moving magnet 25 in the second interposing device 24*b* engages the second recess 22*b* and hold the plunger 18 in the actuated position. Upon application of an opposite magnetic field, $E_2$ the second magnet 25*b* moves vertically away from the second recess 22*b* allowing the plunger 18 to horizontally slide within the cavity 13 back to an at rest position. Typically, field $E_2$ is weaker than field $E_1$ so that spring 16 may return plunger 18 to its de-energized position. Field $E_2$ is strong enough, however, to position moving magnets 25 of interposing devices 24*a* and 24*b*. Upon reaching the at rest position, the first magnet 25*a* engages the first recess 22*a* and hold the plunger 18 in the at rest position. This embodiment provides extra security for the solenoid 10 preventing undesired movement of plunger 18 both when solenoid 100 is energized and de-energized, thus preventing the plunger 18 from undesired movement.

Figure 7:
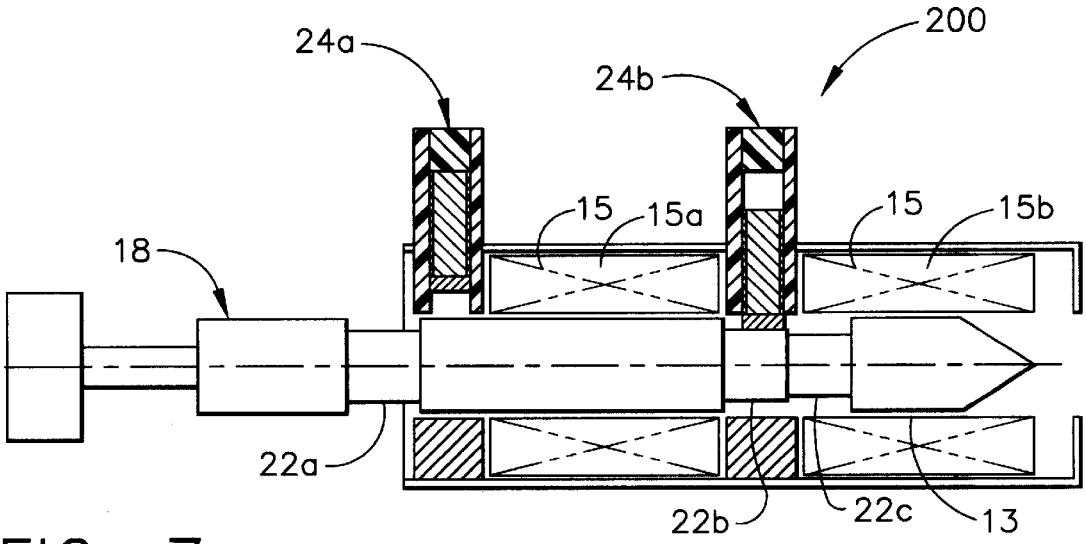
FIG. 7 is a longitudinal cross-section of a third embodiment of the present invention using two coils.

With reference now to FIG. 7 illustrating a third embodiment of the present invention. Solenoid 200 has a body 12, cavity 13, and plunger 18 similar to the solenoids described above. A second coil 15*b* and a third recess 22*c* have been added to provide an additional position in which plunger 18 may be restrained. Thus, solenoid 200 could be used as a three-position switch or actuator.

In summary, numerous benefits are described which result from employing the concepts of the invention. The foregoing description of an exemplary preferred embodiment of the invention is presented for the purposes of illustration and description. It is not intended to be exhaustive or to limit the invention to the precise form disclosed. Obvious modifications or variations are possible in light of the above teachings. The embodiment was selected and described in order to best illustrate the principles of the invention and its practical application to thereby enable one of ordinary skill in the art to best utilize the invention in various embodiments and with various modifications as are suited to particular uses contemplated. It is intended that the scope of the invention be defined by the claims appended hereto.

We claim:

1. An autosecuring solenoid comprising:

a body, said body comprising a cavity and at least one coil;

a plunger, said plunger sliding within said cavity, said plunger comprising a shaft and a recess; and an interposing device, said interposing device comprising a permanent magnet, said magnet engaging said recess of said plunger in a first position when said solenoid is de-energized and said interposing device allowing said plunger to slide within said cavity when said solenoid is energized.

2. An autosecuring solenoid comprising:

a body, said body comprising a cavity and at least one coil;

a plunger, said plunger sliding within said cavity, said plunger comprising a shaft and a recess; and an interposing device, said interposing device comprising a magnet, said magnet engaging said recess in said plunger in a first position when said solenoid is energized and said magnet withdrawn from said recess in said plunger by magnetic force allowing said plunger to slide within said cavity when said solenoid is de-energized.

3. An autosecuring solenoid comprising:

a body, said body comprising a cavity, an end piece, and at least one coil, said coil located along said body;

a plunger having a shaft and a recess, said plunger being able to slide within said cavity;

a spring, said spring engaging said body and said plunger, said spring returns said plunger to a first position when said solenoid is de-energized;

means for energizing and de-energizing said solenoid; and an interposing device, said device comprising:

a magnet and a housing, said magnet sliding within said housing, said magnet engaging said recess to hold said plunger in the first position when said solenoid is de-energized and said magnet disengaging from said recess to allow said plunger to slide within said cavity when said solenoid is energized.

4. An autosecuring solenoid comprising:

a body, said body comprising a cavity and at least one coil;

a plunger, said plunger sliding within said cavity, said plunger comprising a shaft and at least two recesses; and an interposing device, said interposing device comprising a magnet said magnet holding said plunger in a first position when said magnet engages a first recess and said magnet holding said plunger in a second position when said magnet engages a second recess.

5. An autosecuring solenoid comprising:

a body, said body comprising a cavity and at least one coil;

a plunger, said plunger sliding within said cavity, said plunger comprising a shaft and at least two recesses; and at least two interposing devices, each said interposing device comprising a magnet, a first interposing device holding said plunger in a first position when said magnet of said first interposing device engages a first recess and a second interposing device holding said plunger in a second position when said magnet of said second interposing device engages a second recess.

* * * * *